US012065179B2

(12) United States Patent
Jovenall

(10) Patent No.: US 12,065,179 B2
(45) Date of Patent: *Aug. 20, 2024

(54) SYSTEMS AND METHODS FOR CONTROLLING MOVEMENT SPEED OF A LOCOMOTIVE

(71) Applicant: Cattron North America, Inc., Warren, OH (US)

(72) Inventor: Jeremy Jovenall, Mercer, PA (US)

(73) Assignee: Cattron North America, Inc., Warren, OH (US)

( * ) Notice: Subject to any disclaimer, the term of this patent is extended or adjusted under 35 U.S.C. 154(b) by 343 days.

This patent is subject to a terminal disclaimer.

(21) Appl. No.: 17/732,299

(22) Filed: Apr. 28, 2022

(65) Prior Publication Data

US 2022/0250667 A1 Aug. 11, 2022

Related U.S. Application Data

(63) Continuation-in-part of application No. 16/562,733, filed on Sep. 6, 2019, now Pat. No. 11,318,968.
(Continued)

(51) Int. Cl.
*B61L 27/16* (2022.01)
*B61L 15/00* (2006.01)
(Continued)

(52) U.S. Cl.
CPC ..... *B61L 27/16* (2022.01); *B61L 15/0058* (2024.01); *B61L 15/0062* (2024.01);
(Continued)

(58) Field of Classification Search
None
See application file for complete search history.

(56) References Cited

U.S. PATENT DOCUMENTS 6,853,900 B2 2/2005 Rapp et al.
7,203,228 B2 4/2007 Horst et al.
(Continued)

OTHER PUBLICATIONS

Accuspeed Remote Control System, Cattron, https://www.cattron.com/transportation/accuspeed, accessed Sep. 10, 2019, 4 pages.
(Continued)

*Primary Examiner* — Adam D Tissot
(74) *Attorney, Agent, or Firm* — Harness, Dickey & Pierce, P.L.C.; Anthony G. Fussner

(57) ABSTRACT

An automated speed control system for a locomotive having a tractive effort mechanism for moving the locomotive along a track and a braking mechanism for reducing the locomotive's speed along the track. The system including a locomotive controller that includes a memory to store computer-executable instructions, and a processor in communication with the memory to execute the instructions to retrieve one or more track grade maps each indicative of a grade of at least a portion of the track along which the locomotive is travelling, retrieve train makeup, obtain a maximum distance to a specified stopping point of the locomotive along the track, and dynamically calculate a speed limit for movement of the locomotive along the track, according to the retrieved track grade map, retrieved train makeup data, and obtained maximum distance to the specified stopping point.

27 Claims, 4 Drawing Sheets

Related U.S. Application Data

(60) Provisional application No. 62/892,539, filed on Aug. 27, 2019.

(51) Int. Cl.
*B61L 25/02* (2006.01)
*B61L 25/06* (2006.01)
*B61L 27/02* (2006.01)

(52) U.S. Cl.
CPC ..... *B61L 25/021* (2013.01); *B61L 25/06* (2013.01); *B61L 27/02* (2013.01)

(56) References Cited

U.S. PATENT DOCUMENTS 11,318,968 B2 5/2022 Jovenall
11,318,972 B2 5/2022 Jovenall
2009/0312890 A1* 12/2009 Evans ..... B61L 17/00 701/2
2016/0194015 A1* 7/2016 Seaton ..... B61L 27/0077 701/19
2019/0248392 A1* 8/2019 Bar-Tal ..... B61L 15/02

OTHER PUBLICATIONS

Accuspeed, Advanced Automatic Remote Speed Control for Locomotives, http://catalog.jamiesonequipment.com/Asset/Cattron-Laird-Remtron%20Accusp-eed%20Brochure%20JEC.pdf, accessed Sep. 10, 2019, 4 pages.

RCL-II Locomotive Remote Control System Operating Instructions, http://cdn.lairdtech.com/home/brandworld/files/9M02-7564-A002.pdf , see sections 7.7.4, 7.7.4.1, and 7.7.4.2 on p. 64, 75 pages.

* cited by examiner

SYSTEMS AND METHODS FOR CONTROLLING MOVEMENT SPEED OF A LOCOMOTIVE

CROSS-REFERENCE TO RELATED APPLICATIONS

This application is a continuation-in-part of U.S. patent application Ser. No. 16/562,733 filed Sep. 6, 2019 (published as US2021/0061324 on Mar. 4, 2021 and issuing as U.S. Pat. No. 11,318,968 on Mar. 3, 2022). U.S. patent application Ser. No. 16/562,733 claims the benefit and priority of U.S. Provisional Application No. 62/892,539 filed Aug. 27, 2019. The above applications are incorporated herein by reference in their entirety.

FIELD

The present disclosure generally relates to systems and methods for controlling movement speed of a locomotive, such as a dynamically calculated speed limit for a specified stopping trajectory of the locomotive.

BACKGROUND

This section provides background information related to the present disclosure which is not necessarily prior art.

Currently, remote control locomotive (RCL) technology uses various methods to control a stopping trajectory for pull movements. These methods require complex engineering steps to factor grade of the tracks, tonnage of the locomotive and any connected rail cars or other locomotives, locomotive braking force, etc., to calculate the stopping trajectory. The output of this design effort is typically a track map (e.g., including geo-fences, etc.), track-based devices and odometer readings, that provide a typically decreasing speed limit through a region of track with the goal of a complete stop of the locomotive (e.g., a train and/or consist including the locomotive) by a predefined point.

DRAWINGS

The drawings described herein are for illustrative purposes only of selected embodiments and not all possible implementations, and are not intended to limit the scope of the present disclosure.

Corresponding reference numerals indicate corresponding (though not necessarily identical) parts throughout the several views of the drawings.

DETAILED DESCRIPTION

Figure 1:
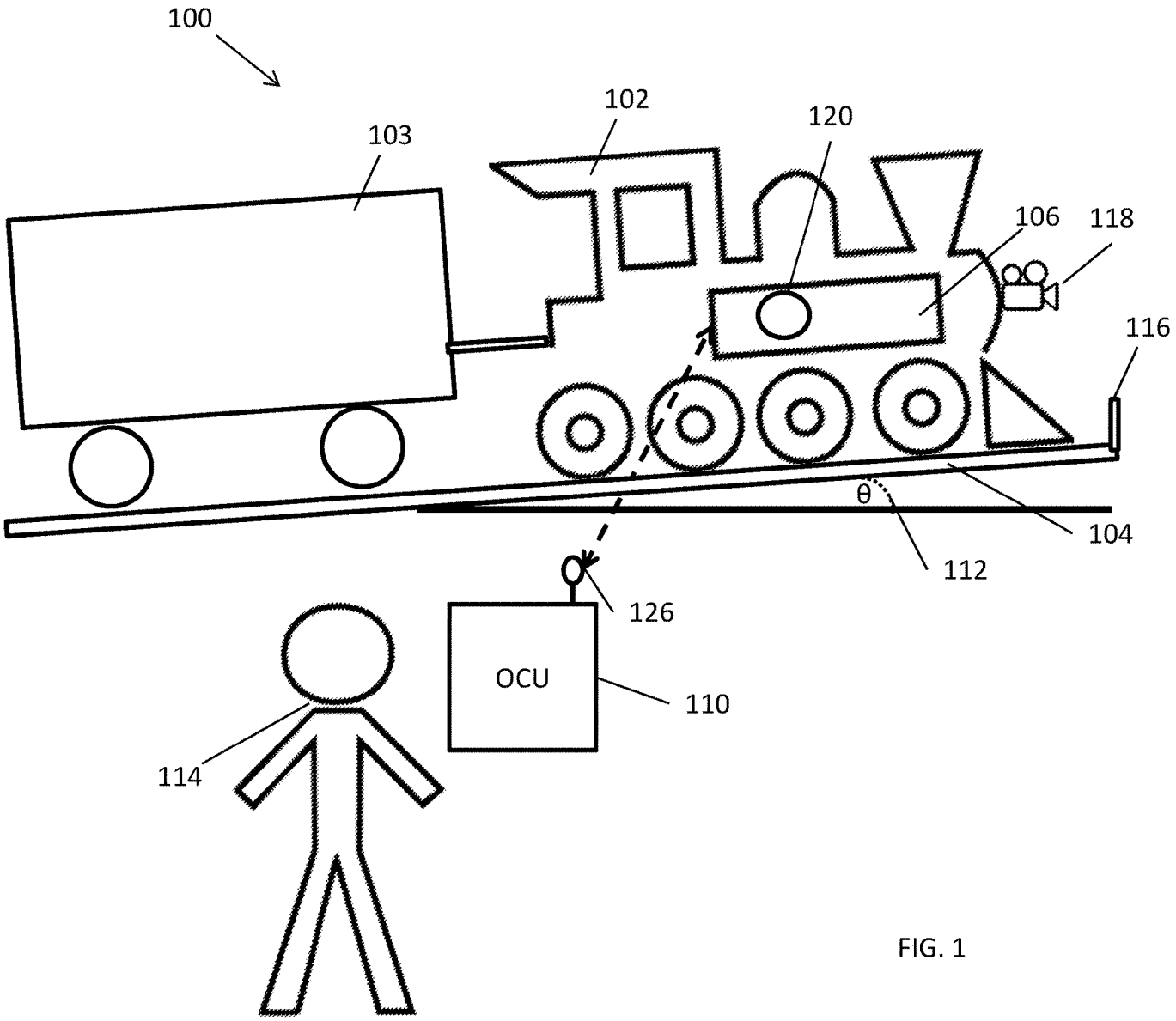
FIG. 1 is a diagram of an automated locomotive speed control system according to one example embodiment of the present disclosure.

Example embodiments will now be described more fully with reference to the accompanying drawings.

Currently, remote control locomotive (RCL) technology uses various methods to control a stopping trajectory for pull movements. These methods require complex engineering steps to factor grade of the tracks, tonnage of the locomotive and any connected rail cars or other locomotives, locomotive braking force, etc., to calculate the stopping trajectory. The output of this design effort is typically a track map (e.g., including geo-fences, etc.), track-based devices and odometer readings, which provide a typically decreasing speed limit through a region of track with the goal of a complete stop of the locomotive by a predefined point.

Speed limits in current pullback protection systems typically assume that a train (e.g., which may include one or more locomotives possibly arranged in a consist, optional rail cars, etc.) has the maximum weight defined for the track, according to engineering calculations performed during creation of the track map. This approach causes shorter, lighter trains to move into a pullback location at a much slower speed than would otherwise be required for the shorter, lighter trains to meet the stopping trajectory. Therefore, the slower speeds increase dwell time of the train and reduce efficiency.

Example embodiments described herein may provide, e.g., dynamic point protection, where RCL equipment is restricted to dynamically calculated speed limits. The inputs for this dynamic calculation may include track grade maps (e.g., loaded into static memory of the RCL, stored on and retrievable from a remote server, etc.), train makeup data (e.g., consist makeup data and train car makeup data stored on and retrievable from a remote server, etc.), maximum distance to a stopping point, etc.

The train makeup data may include only consist makeup data when the train only includes the consist without any train cars coupled to the consist, the train makeup data may include the consist makeup data along with train car makeup data when the train includes the consist with one or more train cars coupled to the consist, the train makeup data may include only train car makeup data and/or a locomotive makeup data when the train includes only a single locomotive coupled to the train car(s), etc. The train makeup data may be stored on and retrievable from a server. Because the number and tonnage of train cars may change dynamically in the switch yard (e.g., train cars may be added, removed, loaded with cargo, and/or unloaded, etc.), a server may advantageously be used to send the train makeup data to the system for the dynamic speed calculations with respect to grade, because the train makeup (e.g., consist and cars, etc.) and grade affect stopping trajectory and therefore affect maximum speed that the RCL enforces to meet the stopping trajectory.

In some embodiments video systems may provide input for the dynamically calculated speed limits. For example, the video systems may be intelligent and capable of detecting obstructions in the track, acting as a watchdog that verifies that the RCL is adhering to the planned stopping trajectory, etc.

An operator may control the train (e.g., one or more locomotives, etc.) with an operator control unit (OCU), and may have the ability to command a lower speed of the train or to stop movement of the train. The dynamic point protection may only provide a speed limit, while allowing the train to move at different speeds at or below the dynamically calculated speed limit. The speed limit may be applicable in a forward (FWD) direction, a reverse (REV) direction, a push orientation with respect to the train, a pull direction with respect to the train, etc.

In some example embodiments, an automated locomotive speed control system is configured for use with a locomotive having a tractive effort mechanism for moving the locomotive along a track and a braking mechanism for reducing a speed of the locomotive along the track. The system includes a locomotive controller, which may be configured to be located on the locomotive.

The locomotive controller includes a memory to store computer-executable instructions, and a processor in communication with the memory to execute the instructions to retrieve one or more track grade maps each indicative of a grade of at least a portion of the track along which the locomotive is travelling, retrieve train makeup data (e.g., makeup data identifying a locomotive or a locomotive consist that includes said locomotive, and any train cars, etc.), obtain a maximum distance to a specified stopping point of the locomotive along the track, and dynamically calculate a speed limit for movement of the locomotive along the track, according to the retrieved track grade map, the retrieved train makeup data, and the obtained maximum distance to the specified stopping point. The train makeup data may include only consist makeup data when the train only includes the consist without any train cars, the train makeup data may include the consist makeup data along with train car makeup data when the train includes the consist with one or more train cars. The train makeup data may include only makeup data of the train cars and/or a locomotive when the train includes a single locomotive coupled to the train car(s), etc.

The one or more track grade maps may be stored in the memory of the locomotive controller, and the locomotive controller is configured to retrieve the one or more track grade maps from the memory. Alternatively, or in addition, the one or more track grade maps may be stored on a server remote from the locomotive controller, and the locomotive controller may be configured to retrieve the one or more track grade maps from the remote server.

The system may include at least one video camera, and the locomotive controller may be configured to receive an input from the at least one video camera and to adjust the dynamically calculated speed limit according to the input received from the at least one video camera. The input received from the at least one video camera may include a detected obstruction on the track along which the locomotive is travelling, a verification alert that the locomotive is not adhering to a specified stopping trajectory, etc.

The example system may include an operator control unit (OCU), and the locomotive controller may be a remote control locomotive (RCL) controller, where the OCU includes a user interface for receiving input from an operator and a wireless interface in communication with the RCL controller. The OCU may be configured to receive one or more control commands from the operator via the user interface, and the OCU may be configured to transmit the received one or more control commands to the RCL controller to control operation of the locomotive.

For example, the one or more control commands may include a lower speed command where the RCL controller is configured to reduce the speed of the locomotive below the dynamically calculated speed limit, the one or more control commands may include a stop movement command where the RCL controller is configured to stop movement of the locomotive prior to reaching the specified stopping point, etc.

The operator control unit may include an enclosure (e.g., a housing) including a user interface, a display, etc. The operator control unit may include a processor, battery, memory, a global navigation satellite system (GNSS) antenna (e.g., a GPS antenna, etc.), one or more accelerometers (e.g., an accelerometer array, a single accelerometer, etc.) for tilt detection, etc.

The locomotive controller may be configured to apply the dynamically calculated speed limit to limit a speed of the locomotive when the locomotive is moving in any suitable direction, such as when the locomotive is moving in a forward direction, a reverse direction, in a push orientation with respect to a train that includes said locomotive, in a pull orientation with respect to the train that includes said locomotive, etc.

The locomotive may include a speedometer, and the locomotive controller may move the locomotive towards a specified stopping point based on input from the speedometer. For example, depending on a distance to the specified stopping point, one or more track grade maps, train makeup data (e.g., makeup data identifying a locomotive or a locomotive consist that includes said locomotive, and any train cars, etc.), a maximum speed may be obtained for moving the locomotive and a stopping trajectory may be calculated to stop at a specified stopping point (e.g., within a specified tolerance of 0.1%, 1%, 10%, etc.).

Although an OCU use case is described above, other embodiments may not include an OCU, and stopping trajectories, specified stopping points, etc. may be sent to the locomotive controller from a remote device. For example, the stopping trajectories, specified stopping points, etc. may be transmitted by a server, central computing device, etc. that controls semi-autonomous RCL movements, remotely controls yard switches, etc.

The locomotive controller may be configured to maintain a movement speed of the locomotive below or equal to a specified speed threshold while controlling spotting distance movement of the locomotive. In some embodiments, the locomotive controller is configured to receive an updated inputs (e.g., from a video system), updated measurement parameters (e.g., distances, speeds, etc.) while controlling movement of the locomotive along the track via the tractive effort mechanism, and update the dynamically calculated speed limit value according to the received update data to provide dynamic speed limit control.

In some embodiments, the locomotive controller is configured to store multiple movement models corresponding to different stopping trajectories, with each movement model including different tractive effort and/or braking control parameters. The locomotive controller may be configured to select one of the movement models corresponding to the dynamically calculated speed limit and/or stopping trajectory to control stopping trajectory movement of the locomotive.

The system may include a wheel size detector configured to determine a size of the wheel, where the speedometer is configured to monitor the speed of movement of the locomotive along the track according to the determined size of the wheel and a number of rotations and/or fractions of rotations of the wheel.

With reference to the figures, FIG. 1 illustrates an automated locomotive speed control system 100 for a locomotive 102 according to some aspects of the present disclosure. The locomotive 102 generally includes a tractive effort mechanism for moving the locomotive 102 along a track 104, and a braking mechanism for reducing a speed of the locomotive 102 along the track 104.

Figure 2:
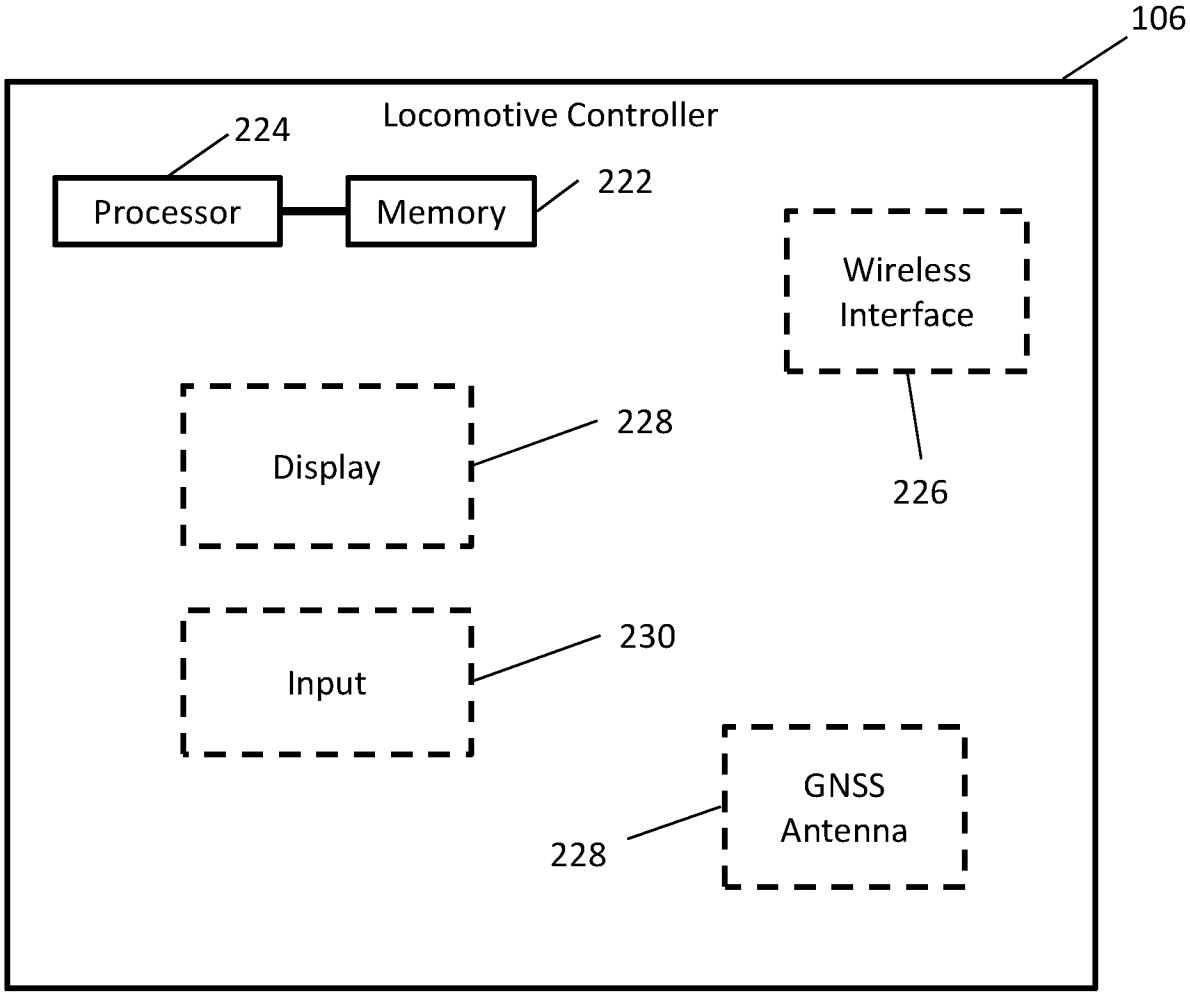
FIG. 2 is a block diagram of the locomotive controller of FIG. 1.

The system 100 includes a locomotive controller 106, which is illustrated in FIG. 1 as being located onboard the locomotive 102. As shown in FIG. 2, the locomotive controller 106 includes a memory 222 to store computer-executable instructions, and a processor 224 in communication with the memory 222 to execute the instructions to retrieve one or more track grade maps each indicative of a grade 112 of at least a portion of the track 104 along which the locomotive 102 is travelling.

The locomotive controller 106 is configured to retrieve train makeup data (e.g., makeup data identifying a locomotive or a locomotive consist that includes said locomotive 102, and any train cars 103, etc.), obtain a maximum distance to a specified stopping point 116 of the locomotive 102 along the track 104, and dynamically calculate a speed limit for movement of the locomotive 102 along the track 104, according to the retrieved track grade map, the retrieved train makeup data, and the obtained maximum distance to the specified stopping point 116.

The speed limit for movement of the locomotive 102 along the track 104 may be dynamically calculated using any suitable algorithm, process, etc., such as a physics-based calculation. For example, the grade 112 of the track 104 helps provide an understanding of the effect of gravity on the movement of the locomotive 102 and any train cars 103 coupled to the locomotive 102 (e.g., the grade 112 of the track 104 may indicate the strength of gravitational force slowing down the locomotive 102 when climbing a hill, speeding up the locomotive 102 when going down a hill, etc.).

The train makeup data may provide information about the tonnage, weight, stock, etc. of one or more rail cars 103 of the train, of one or more locomotives 102 of the train, etc. The train makeup data may be used in combination with the grade 112 of the track 104 to calculate forces on the train as it moves along different section of the track 104.

The train makeup data may be retrieved from a server, etc. For example, the number and tonnage of rail cars 103 of the train may change dynamically in a switch yard, etc., and a remote server may provide updated train makeup data to the locomotive controller 106 as the number and tonnage of rail cars 103 changes so the locomotive controller 106 may update the dynamic speed limit calculations (e.g., because the train makeup and grade may affect stopping trajectory of the train and therefore affect the maximum speed that the locomotive controller 106 enforces to meet the stopping trajectory).

Other factors may be included in the dynamic speed limit calculation, such as a rolling resistance (e.g., a retarding force from wheel bearings and wheels of the locomotive 102 and/or train cars 103 moving on rails of the track 104), a curvature of the track 104 that adds resistance to movement of the train, etc.

The maximum specified stopping distance 116 may be a target place on the track 104 that the system must ensure is not passed. This may provide a location where a speed of zero is required, thereby allowing the system to calculate movement back to the current location of the train and to derive a maximum speed limit for the current location. For example, the locomotive controller 106 may receive the maximum distance to the specified stopping point 116 from a remote server (e.g., the maximum distance may be received at the same time as the train makeup data, etc.), the locomotive controller 106 may determine the maximum distance based on data stored in memory or by performing a maximum distance calculation, etc.

The number of braking axles in the locomotive portion of the train may also affect the dynamic speed limit calculations. In cases of extreme grade (e.g., more than 2% downhill, more than 5% downhill, etc.), and/or an increased desired entry speed, train brakes may be a requirement to add retarding force to meet the stopping point 116.

Although FIG. 1 illustrates a single locomotive 102, the locomotive 102 may be part of a locomotive consist that includes one or more locomotives, rail cars, etc. coupled to the locomotive 102. The locomotives of the consist may operate in tandem (e.g., by remote control, etc.), and may require electrical and pneumatic connections in order to operate together. As mentioned above, the locomotive controller 106 (e.g., a remote control locomotive (RCL) controller, etc.) may be configured to control movement of the locomotive consist along the track 104 (e.g., via a tractive effort mechanism, via a pneumatic braking system, etc.).

Similarly, although FIG. 1 illustrates a single train car 103, other embodiments may include a train having more than one train car 103 coupled to the locomotive 102, no train cars 103 coupled to the locomotive 102, etc.

As shown in FIG. 2, the locomotive controller 106 includes the memory 222 configured to store computer executable instruction, and the processor 224 configured to execute the computer-executable instructions stored in memory 222. The locomotive controller 106 may further include one or more wireless interfaces 226 (e.g., data ports), such as a short-range wireless communication interface, a Wi-Fi wireless communication interface, a cellular communication interface, other radio frequency (RF) interfaces, etc.

The locomotive controller 106 may also include a global navigation satellite system (GNSS) antenna 228 (e.g., a GPS antenna, etc.), one or more accelerometers (e.g., an accelerometer array, a single accelerometer, etc.), etc. The locomotive controller 106 can report a location, one or more parameters, etc. to the operator control unit 110.

The locomotive controller 106 may include an optional display 230 and an input 232. The optional display 230 can be any suitable display (e.g., a liquid crystal display (LCD), light emitting diodes (LED), indicator lights, etc.). The input 232 can include any suitable input element(s) (e.g., a keypad, touchscreen, switches, etc.), for receiving inputs (e.g., commands, etc.) from an operator.

The one or more track grade maps may be stored in the memory 222 of the locomotive controller 106, and the locomotive controller 106 may be configured to retrieve the one or more track grade maps from the memory 222. Alternatively, or in addition, the one or more track grade maps may be stored on a server remote from the locomotive controller 106, and the locomotive controller 106 may be configured to retrieve the one or more track grade maps from the remote server.

For example, and as shown in FIG. 1, the grade 112 of the track 104 may be defined by an angle θ with respect to a plane perpendicular to gravity (e.g., a one degree grade, a five degree grade, etc.). The track grade map(s) may be used to indicate the grade along different portions of the track 104 between the locomotive 102 and the stopping point 116, in order to determine a preferred tractive effort, braking effort, speed limit, etc. for the locomotive 102 to traverse the track 104 according to the corresponding grade 112.

The system 100 may include at least one video camera 118. The locomotive controller 106 may be configured to receive an input from the at least one video camera 118 to adjust the dynamically calculated speed limit according to the input received from the at least one video camera 118.

For example, the input received from the at least one video camera 118 may include a detected obstruction on the track 104 along which the locomotive 102 is travelling, a verification alert that the locomotive 102 is not adhering to a specified stopping trajectory to properly arrive at the specified stopping point 116, etc.

The following is an example of how the camera 118 may be implemented, and how the speed limits might be adjusted based on the camera input. As shown in FIG. 1, a camera 118 that supplies data to an intelligent video processing unit may be added to the locomotive 102. The camera 118 may face a point of a pull movement, to detect an obstruction in the track 104, to confirm that the position of the locomotive 102 is consistent with the dynamically calculated stopping trajectory, etc.

In the event that an obstruction is detected along the track 104, the video system may alert the locomotive controller 106 (e.g., RCL) to command an appropriate speed reduction, to stop movement, etc. The video system may verify that track switches were aligned to the correct direction for the planned movement.

If the video system detects that the speed of the train is not meeting the stopping trajectory, the video system may alert the locomotive controller 106 to reduce speed. The train may be travelling at a higher speed than permitted by the stopping trajectory for several reasons, some of which are out of the control of the locomotive controller 106, such as an inadequate number of cars 103 having train brakes laced, environmental issues such as wet rails of the track 104 or ice buildup on brake shoes impeding braking effort, incorrect train makeup data being received, incorrect grade maps being received. etc.

In other embodiments, the camera 118 may be located in any other suitable location, which may or may not be on the locomotive 102 and/or a train car 103. For example, for shove movements the camera(s) 118 may be stationary at specified locations in the yard for monitoring purposes. The camera system may provide data to determine if the movement was a pull or shove movement. Shove movements may require adjustments to stopping trajectory to account for slack in the train running out when speed is decreased to prevent an overrun of the maximum distance. The camera 118 is an extra or optional layer of protection that may not be necessarily required or implemented in all exemplary embodiments.

Figure 3:
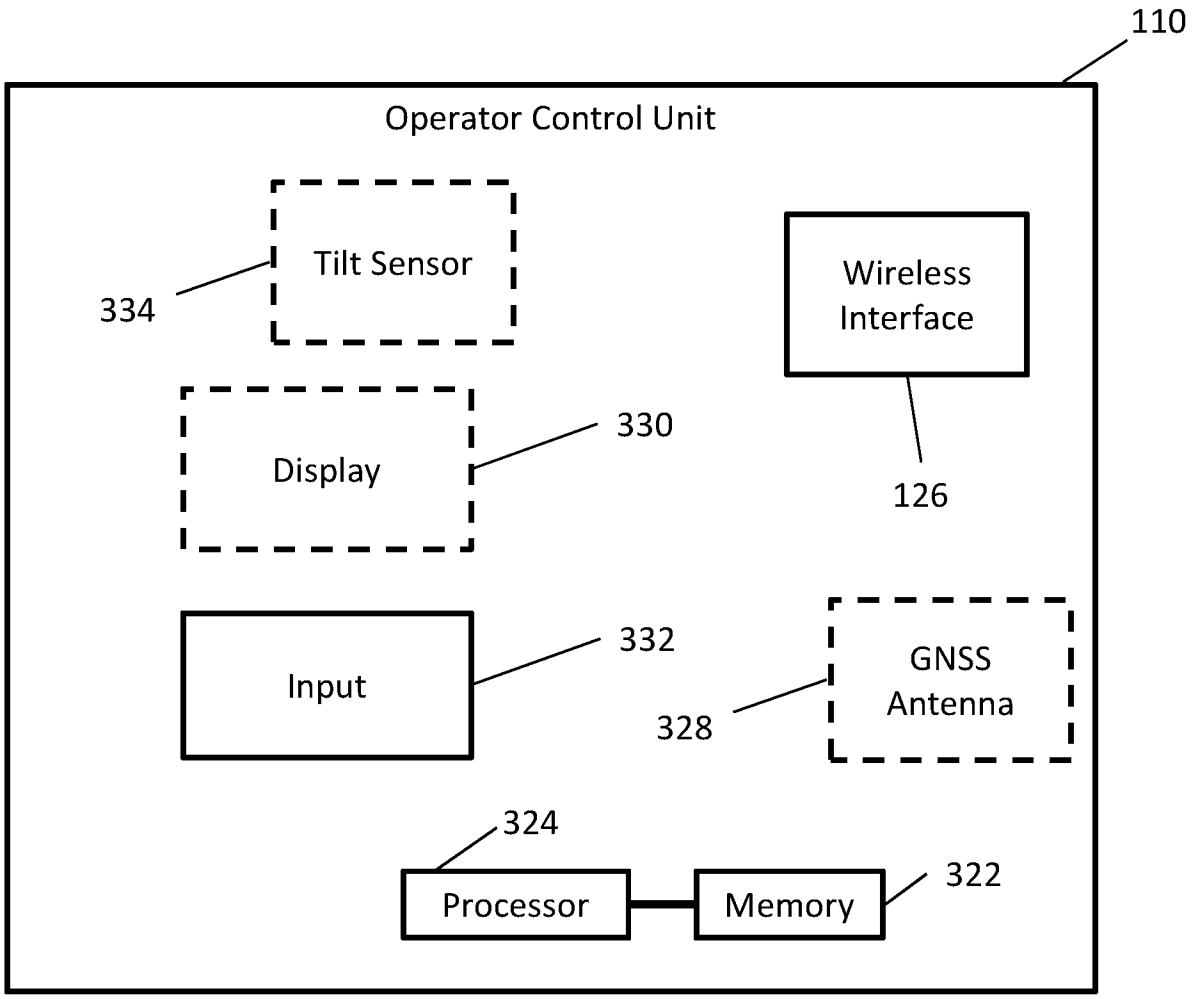
FIG. 3 is a block diagram of the operator control unit of FIG. 1.

The example system 100 may include an operator control unit (OCU) 110, and the locomotive controller 106 may be a remote control locomotive (RCL) controller. As shown in FIG. 3, the OCU 110 may include an input 332 (e.g., a user interface) for receiving input from an operator 114, and a wireless interface 126 in communication with the RCL controller 106.

For example, the operator control unit 110 may include a memory 322 and a processor 324. The processor 324 may be configured to execute instructions stored in the memory 322 to control movement of the locomotive 102, to control a direction of movement of the locomotive 102, to control a speed of the locomotive 102, to detect a tilt condition of the operator control unit 110, to detect a vigilance condition of the operator control unit 110, to stop movement of the locomotive 102, to initiate a spotting feature for coupling and/or uncoupling of the locomotive, etc.

The operator control unit 110 may include the wireless interface 126 which may communicate with the locomotive controller 106 via an RF channel, etc. The operator control unit 110 may include an optional global navigation satellite system (GNSS) antenna 328 for determining a location of the operator control unit 110. For example, the GNSS antenna 328 may be a global positioning system (GPS) antenna.

The operator control unit 110 may include a tilt sensor 334 (e.g., an accelerometer array, a single accelerometer, etc.) for determining a tilt condition (e.g., a fall event of a field operator 114 (FIG. 1), etc.). The operator control unit 110 may include an enclosure (e.g., a housing) including the user interface 332, the display 330, etc.

As mentioned above, the OCU 110 may be configured to receive one or more control commands from the operator 114 via the user interface 332, and the OCU 110 may be configured to transmit the received one or more control commands to the RCL controller 106 to control operation of the locomotive 102.

For example, the one or more control commands may include a lower speed command where the RCL controller 106 is configured to reduce the speed of the locomotive 102 below the dynamically calculated speed limit. The locomotive 102 may include a speedometer 120, and the locomotive controller 106 may receive input from the speedometer 120 to maintain a speed of the locomotive 102 below the dynamically calculated speed limit. When the RCL controller 106 receives a lower speed command from the OCU 110, the RCL controller 106 may reduce a speed of the locomotive 102 to a threshold below the dynamically calculated speed limit.

As another example, the one or more control commands from the OCU 110 may include a stop movement command. In this example, the RCL controller 106 may be configured to stop movement of the locomotive 102 prior to reaching the specified stopping point 116, etc.

The locomotive controller 106 may be configured to apply the dynamically calculated speed limit to limit a speed of the locomotive 102 when the locomotive 102 is moving in any suitable direction, such as when the locomotive 102 is moving in a forward direction, a reverse direction, in a push orientation with respect to a train that includes said locomotive 102, in a pull orientation with respect to the train that includes said locomotive 102, etc.

Figure 4:
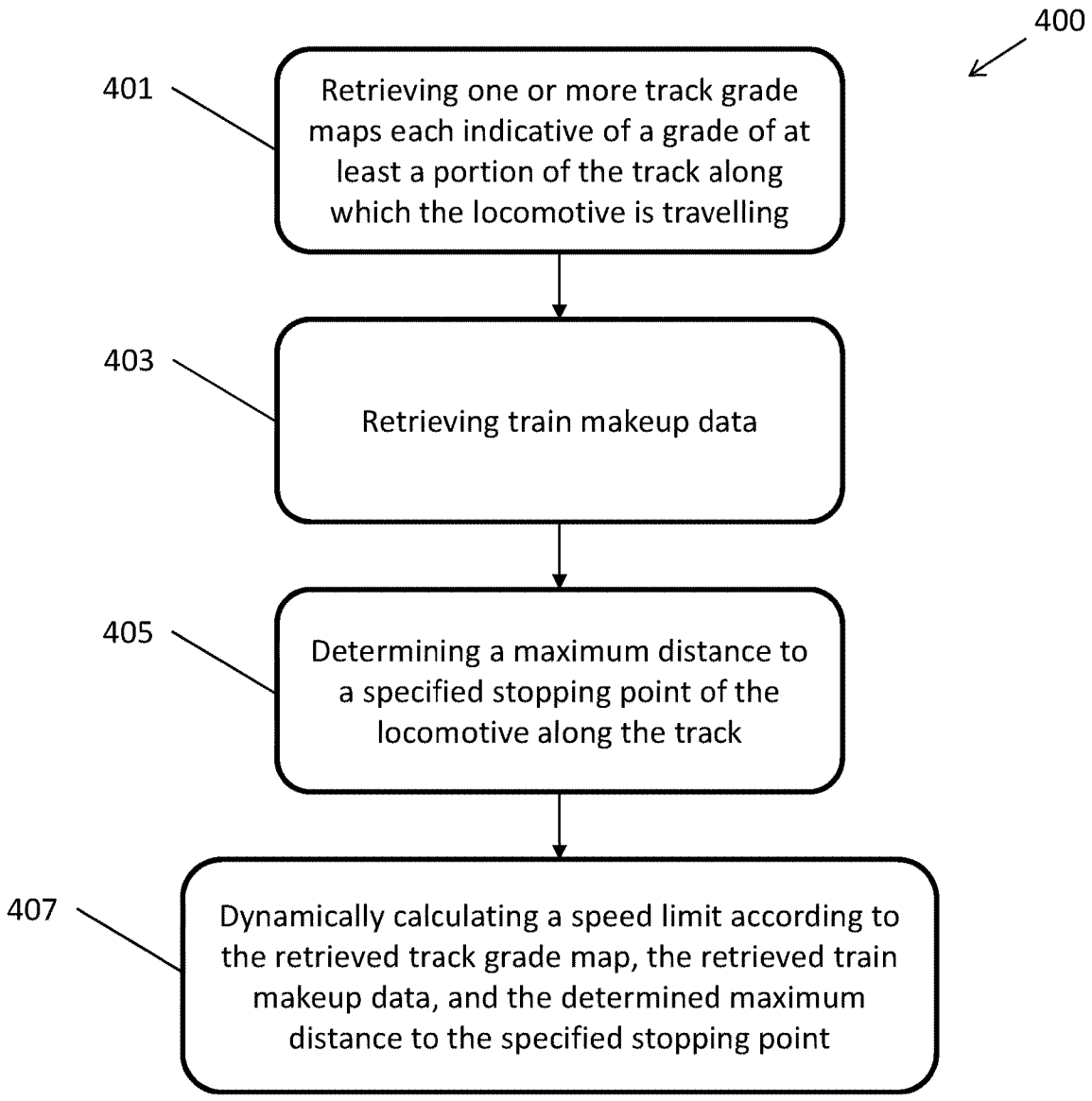
FIG. 4 is a flow chart illustrating an example method for controlling speed of a locomotive according to another example embodiment of the present disclosure.

An example method 400 for controlling speed of a locomotive is disclosed in FIG. 4. The locomotive includes a tractive effort mechanism for moving the locomotive along a track, and a braking mechanism for reducing a speed of the locomotive along the track. As shown in FIG. 4, the method 400 includes, at 401, retrieving one or more track grade maps each indicative of a grade of at least a portion of the track along which the locomotive is travelling, via a locomotive controller located on the locomotive.

At 403, the method 400 includes retrieving, by the locomotive controller, train makeup data (e.g., makeup data identifying a locomotive or a locomotive consist that includes said locomotive, and any train cars, etc.). The train makeup data may be retrieved from a server, etc. For example, the number and tonnage of rail cars of the train may change dynamically in a switch yard, etc., and a remote server may provide updated train makeup data to the locomotive controller as the number and tonnage of rail cars changes so the locomotive controller may update the dynamic speed limit calculations (e.g., because the train makeup and grade may affect stopping trajectory of the train and therefore affect the maximum speed that the locomotive controller enforces to meet the stopping trajectory).

At 405, the method 400 includes obtaining a maximum distance to a specified stopping point of the locomotive along the track. For example, the locomotive controller may receive the maximum distance to the specified stopping point from a remote server (e.g., the maximum distance may be received at the same time as the train makeup data, etc.), the locomotive controller may determine the maximum distance based on data stored in memory or by performing a maximum distance calculation, etc.

The locomotive controller dynamically calculates a speed limit for movement of the locomotive along the track according to the retrieved track grade map, the retrieved train makeup data, and the obtained maximum distance to the specified stopping point, at 407.

The one or more track grade maps may be stored in at least one of the memory of the locomotive controller, and a server located remote from the locomotive controller. The method optionally includes receiving an input from at least one video camera, and adjusting, by the locomotive controller, the dynamically calculated speed limit according to the input received from the at least one video camera. The input received from the at least one video camera may include at least one of a detected obstruction on the track along which the locomotive is travelling and a verification alert that the locomotive is not adhering to a specified stopping trajectory.

In some embodiments, the method may include receiving, by the locomotive controller, one or more control commands transmitted by an operator control unit (OCU) in wireless communication with the locomotive controller. For example, the method may include reducing, by the locomotive controller, the speed of the locomotive below the dynamically calculated speed limit when the one or more commands received from the OCU include a lower speed command, and the method may include stopping, by the locomotive controller, movement of the locomotive prior to reaching the specified stopping point when the one or more commands received from the OCU include a stop movement command.

According to another example embodiment of the present disclosure, a locomotive controller includes memory configured to store computer-executable instructions, and a processor in communication with the memory to execute the instructions to retrieve one or more track grade maps each indicative of a grade of at least a portion of the track along which the locomotive is travelling.

The processor is also configured to retrieve train makeup data (e.g., makeup data identifying a locomotive or a locomotive consist that includes said locomotive, and any train cars, etc.), obtain a maximum distance to a specified stopping point of the locomotive along the track, and dynamically calculate a speed limit for movement of the locomotive along the track, according to the retrieved track grade map, the retrieved train makeup data, and the obtained maximum distance to the specified stopping point.

The train makeup data may include consist makeup data identifying a locomotive consist that includes said locomotive and train car makeup data identifying train cars coupled to the locomotive consist. The locomotive controller may be configured to retrieve the train makeup data including updated train makeup data reflecting any changes to the train makeup. The locomotive controller may also be configured to adjust the calculated speed limit for the locomotive, according to the grade of the portion of the track along which the locomotive is travelling and the updated train makeup data reflecting any changes to the train makeup.

In exemplary embodiments, an automated locomotive speed control system for a locomotive comprises a locomotive controller including a memory and a processor. The memory is configured to store computer-executable instructions. The processor is in communication with the memory to execute the instructions to: retrieve one or more track grade maps each indicative of a grade of at least a portion of the track along which the locomotive is travelling; retrieve train makeup data; obtain a maximum distance to a specified stopping point of the locomotive along the track; and calculate a speed limit for the locomotive along the track to meet a stopping trajectory for providing dynamic point protection, according to the retrieved track grade map, the retrieved train makeup data, and the obtained maximum distance to the specified stopping point.

In exemplary embodiments, the train makeup data includes consist makeup data identifying a locomotive consist that includes said locomotive and train car makeup data identifying train cars coupled to the locomotive consist. The locomotive controller may be configured to receive an input from at least one camera. The input received from the at least one camera may include detection of the consist makeup data identifying the locomotive consist that includes said locomotive and the train car makeup data identifying the train cars coupled to the locomotive consist. The input received from the at least one camera may include a type and identifying number of said locomotive consist and an identifying number for each train car coupled to the locomotive consist. The system may be configured to be operable for determining tonnage of the train cars coupled to the locomotive consist based on the identifying numbers of the train cars. For example, the system may cross-reference the identifying numbers of the trailing cars with existing railroad systems to determine tonnage of the trailing cars.

In exemplary embodiments, the locomotive controller is configured to receive an input from the at least one camera. The input received from the at least one camera includes detection of one or more features external to the locomotive to verify that the locomotive is located on the track in a location that corresponds to the assumed location in the retrieved track grade map. The one or more features detected by the camera may comprise recognizable existing landmarks, intentionally placed markers, etc.

In exemplary embodiments, the train makeup data includes updated train makeup data reflecting any changes to the train makeup. The system is configured to adjust the calculated speed limit for the locomotive according to the grade of the portion of the track along which the locomotive is travelling and the updated train makeup data reflecting any changes to the train makeup.

In exemplary embodiments, the train makeup data is stored on a server remote from the locomotive controller. The locomotive controller is configured to retrieve the train makeup data from the remote server. The locomotive controller is configured to obtain the maximum distance to the specified stopping point by receiving the maximum distance from the server remote from the locomotive controller at about the same time as the train makeup data.

In exemplary embodiments, the locomotive controller is configured to receive an input from at least one camera and to adjust the calculated speed limit for the locomotive according to the input received from the at least one camera. The input received from the at least one camera may include a detected obstruction on the track along which the locomotive is travelling and/or a verification alert that the locomotive is not adhering to the stopping trajectory.

In exemplary embodiments, the system comprises an operator control unit (OCU). The locomotive controller comprises a remote control locomotive (RCL) controller. The OCU includes a user interface for receiving input from an operator, and a wireless interface in communication with the RCL controller. The OCU is configured to receive one or more control commands from the operator via the user interface. The OCU is configured to transmit the received one or more control commands to the RCL controller to control operation of the locomotive. The one or more control commands may include a lower speed command, and the RCL controller is configured to reduce the speed of the locomotive below the calculated speed limit. The one or more control commands may include a stop movement command, and the RCL controller is configured to stop movement of the locomotive prior to reaching the specified stopping point.

In exemplary embodiments, the locomotive controller is configured to apply the calculated speed limit to limit a speed of the locomotive when the locomotive is moving in a forward direction; and/or the locomotive controller is configured to apply the calculated speed limit to limit a speed of the locomotive when the locomotive is moving in a reverse direction; and/or the locomotive controller is configured to apply the calculated speed limit to limit a speed of the locomotive when the locomotive is moving in a push orientation with respect to the train that includes said locomotive; and/or the locomotive controller is configured to apply the calculated speed limit to limit a speed of the locomotive when the locomotive is moving in a pull orientation with respect to the train that includes said locomotive.

In exemplary embodiments, the system comprises the locomotive including the tractive effort mechanism for moving the locomotive along the track and the braking mechanism for reducing the speed of the locomotive along the track. The locomotive controller is located on the locomotive.

In exemplary embodiments, the one or more track grade maps are stored in the memory of the locomotive controller, and the locomotive controller is configured to retrieve the one or more track grade maps from the memory; and/or the one or more track grade maps are stored on a server remote from the locomotive controller, and the locomotive controller is configured to retrieve the one or more track grade maps from the remote server.

In exemplary embodiments, a method of controlling speed of a locomotive comprises: retrieving, via a locomotive controller, one or more track grade maps each indicative of a grade of at least a portion of the track along which the locomotive is travelling; retrieving, by the locomotive controller, train makeup data; obtaining a maximum distance to a specified stopping point of the locomotive along the track; and calculating, by the locomotive controller, a speed limit for the locomotive along the track to meet a stopping trajectory to thereby provide dynamic point protection, according to the retrieved track grade map, the retrieved train makeup data, and the obtained maximum distance to the specified stopping point.

In exemplary embodiments, the method includes receiving an input from at least one camera, and adjusting, by the locomotive controller, the calculated speed limit for the locomotive, according to the input received from the at least one camera. The input received from the at least one camera may include at least one of a detected obstruction on the track along which the locomotive is travelling and/or a verification alert that the locomotive is not adhering to the stopping trajectory.

In exemplary embodiments, the train makeup data includes consist makeup data identifying a locomotive consist that includes said locomotive and train car makeup data identifying train cars coupled to the locomotive consist. The method includes receiving an input from at least one camera including detection of the consist makeup data identifying the locomotive consist that includes said locomotive and the train car makeup data identifying the train cars coupled to the locomotive consist. The input received from the at least one camera may include a type and identifying number of said locomotive consist and an identifying number for each train car coupled to the locomotive consist. The method may include determining tonnage of the train cars coupled to the locomotive consist based on the identifying numbers of the train cars. For example, the method may include cross-referencing the identifying numbers of the trailing cars with existing railroad systems to determine tonnage of the trailing cars.

In exemplary embodiments, the method includes receiving an input from at least one camera including detection of one or more features external to the locomotive; and using the detected one or more features external to the locomotive to verify that the locomotive is located on the track in a location that corresponds to the assumed location in the retrieved track grade map. The one or more features detected by the camera may comprise recognizable existing landmarks, intentionally placed markers, etc.

In exemplary embodiments, the method includes receiving, by the locomotive controller, one or more control commands transmitted by an operator control unit (OCU) in wireless communication with the locomotive controller; reducing, by the locomotive controller, the speed of the locomotive below the calculated speed limit when the one or more commands received from the OCU include a lower speed command; and stopping, by the locomotive controller, movement of the locomotive prior to reaching the specified stopping point when the one or more commands received from the OCU include a stop movement command.

In exemplary embodiments, the train makeup data includes updated train makeup data reflecting any changes to the train makeup. The method includes adjusting the calculated speed limit for the locomotive along the track to meet the stopping trajectory according to the grade of the portion of the track along which the locomotive is travelling and the updated train makeup data reflecting any dynamic changes to the train makeup.

In exemplary embodiments, the train makeup data includes consist makeup data identifying a locomotive consist that includes said locomotive and train car makeup data identifying train cars coupled to the locomotive consist; and/or the one or more track grade maps are stored in at least one of the memory of the locomotive controller and/or a server located remote from the locomotive controller.

As described herein, the example operator control units and locomotive controllers may include a microprocessor, microcontroller, integrated circuit, digital signal processor, etc., which may include memory. The operator control units and locomotive controllers may be configured to perform (e.g., operable to perform, etc.) any of the example processes described herein using any suitable hardware and/or software implementation. For example, the operator control units and locomotive controllers may execute computer-executable instructions stored in a memory, may include one or more logic gates, control circuitry, etc.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purposes of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 29, or 3-8, it is also envisioned that Parameter X may have other ranges of values including 1-9, 1-8, 1-3, 1-2, 2-10, 2-8, 2-3, 3-10, and 3-9.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally", "about", and "substantially" may be used herein to mean within manufacturing tolerances.

The terminology used herein is for the purpose of describing particular example embodiments only and is not intended to be limiting. For example, when permissive phrases, such as "may comprise", "may include", and the like, are used herein, at least one embodiment comprises or includes the feature(s). As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An automated locomotive speed control system for a locomotive, the locomotive including a tractive effort mechanism for moving the locomotive along a track and a braking mechanism for reducing a speed of the locomotive along the track, the system comprising a locomotive controller including:

a memory to store computer-executable instructions; and a processor in communication with the memory to execute the instructions to:

retrieve one or more track grade maps each indicative of a grade of at least a portion of the track along which the locomotive is travelling;

retrieve train makeup data;

obtain a maximum distance to a specified stopping point of the locomotive along the track; and calculate a speed limit for the locomotive along the track to meet a stopping trajectory for providing dynamic point protection, according to the retrieved track grade map, the retrieved train makeup data, and the obtained maximum distance to the specified stopping point.

2. The system of claim 1, wherein the train makeup data includes consist makeup data identifying a locomotive consist that includes said locomotive and train car makeup data identifying train cars coupled to the locomotive consist.

3. The system of claim 2, further comprising at least one camera, wherein the locomotive controller is configured to receive an input from the at least one camera, and wherein the input received from the at least one camera includes detection of the consist makeup data identifying the locomotive consist that includes said locomotive and the train car makeup data identifying the train cars coupled to the locomotive consist.

4. The system of claim 3, wherein the input received from the at least one camera includes a type and identifying number of said locomotive consist and an identifying number for each train car coupled to the locomotive consist.

5. The system of claim 4, wherein the system is configured to be operable for determining tonnage of the train cars coupled to the locomotive consist based on the identifying numbers of the train cars.

6. The system of claim 1, further comprising at least one camera, wherein the locomotive controller is configured to receive an input from the at least one camera, and wherein the input received from the at least one camera includes detection of one or more features external to the locomotive to verify that the locomotive is located on the track in a location that corresponds to the assumed location in the retrieved track grade map.

7. The system of claim 1, wherein:

the train makeup data includes updated train makeup data reflecting any changes to the train makeup; and the system is configured to adjust the calculated speed limit for the locomotive according to the grade of the portion of the track along which the locomotive is travelling and the updated train makeup data reflecting any changes to the train makeup.

8. The system of claim 1, wherein:

the train makeup data is stored on a server remote from the locomotive controller;

the locomotive controller is configured to retrieve the train makeup data from the remote server; and the locomotive controller is configured to obtain the maximum distance to the specified stopping point by receiving the maximum distance from the server remote from the locomotive controller at about the same time as the train makeup data.

9. The system of claim 1, further comprising at least one camera, wherein the locomotive controller is configured to receive an input from the at least one camera and to adjust the calculated speed limit for the locomotive according to the input received from the at least one camera.

10. The system of claim 6, wherein the input received from the at least one camera includes a detected obstruction on the track along which the locomotive is travelling and/or a verification alert that the locomotive is not adhering to the stopping trajectory.

11. The system of claim 1, further comprising an operator control unit (OCU), wherein:

the locomotive controller comprises a remote control locomotive (RCL) controller;

the OCU includes a user interface for receiving input from an operator, and a wireless interface in communication with the RCL controller;

the OCU is configured to receive one or more control commands from the operator via the user interface; and the OCU is configured to transmit the received one or more control commands to the RCL controller to control operation of the locomotive.

12. The system of claim 11, wherein:

the one or more control commands include a lower speed command, and the RCL controller is configured to reduce the speed of the locomotive below the calculated speed limit; and/or the one or more control commands include a stop movement command, and the RCL controller is configured to stop movement of the locomotive prior to reaching the specified stopping point.

13. The system of claim 1, wherein:

the locomotive controller is configured to apply the calculated speed limit to limit a speed of the locomotive when the locomotive is moving in a forward direction; and/or the locomotive controller is configured to apply the calculated speed limit to limit a speed of the locomotive when the locomotive is moving in a reverse direction; and/or the locomotive controller is configured to apply the calculated speed limit to limit a speed of the locomotive when the locomotive is moving in a push orientation with respect to the train that includes said locomotive; and/or the locomotive controller is configured to apply the calculated speed limit to limit a speed of the locomotive when the locomotive is moving in a pull orientation with respect to the train that includes said locomotive.

14. The system of claim 1, wherein the system comprises the locomotive including the tractive effort mechanism for moving the locomotive along the track and the braking mechanism for reducing the speed of the locomotive along the track, and wherein the locomotive controller is located on the locomotive.

15. The system of claim 1, wherein:

the one or more track grade maps are stored in the memory of the locomotive controller, and the locomotive controller is configured to retrieve the one or more track grade maps from the memory; and/or the one or more track grade maps are stored on a server remote from the locomotive controller, and the locomotive controller is configured to retrieve the one or more track grade maps from the remote server.

16. A method of controlling speed of a locomotive, the locomotive including a tractive effort mechanism for moving the locomotive along a track, and a braking mechanism for reducing a speed of the locomotive along the track, the method comprising:

retrieving, via a locomotive controller, one or more track grade maps each indicative of a grade of at least a portion of the track along which the locomotive is travelling;

retrieving, by the locomotive controller, train makeup data;

obtaining a maximum distance to a specified stopping point of the locomotive along the track; and calculating, by the locomotive controller, a speed limit for the locomotive along the track to meet a stopping trajectory to thereby provide dynamic point protection, according to the retrieved track grade map, the retrieved train makeup data, and the obtained maximum distance to the specified stopping point.

17. The method of claim 16, further comprising receiving an input from at least one camera, and adjusting, by the locomotive controller, the calculated speed limit for the locomotive, according to the input received from the at least one camera.

18. The method of claim 17, wherein the input received from the at least one camera includes at least one of a detected obstruction on the track along which the locomotive is travelling and/or a verification alert that the locomotive is not adhering to the stopping trajectory.

19. The method of claim 16, wherein:

the train makeup data includes consist makeup data identifying a locomotive consist that includes said locomotive and train car makeup data identifying train cars coupled to the locomotive consist; and the method includes receiving an input from at least one camera including detection of the consist makeup data identifying the locomotive consist that includes said locomotive and the train car makeup data identifying the train cars coupled to the locomotive consist.

20. The method of claim 19, wherein the input received from the at least one camera includes a type and identifying number of said locomotive consist and an identifying number for each train car coupled to the locomotive consist.

21. The method of claim 20, wherein the method includes determining tonnage of the train cars coupled to the locomotive consist based on the identifying numbers of the train cars.

22. The method claim 16, wherein the method includes:

receiving an input from at least one camera including detection of one or more features external to the locomotive; and using the detected one or more features external to the locomotive to verify that the locomotive is located on the track in a location that corresponds to the assumed location in the retrieved track grade map.

23. The method of claim 16, further comprising:

receiving, by the locomotive controller, one or more control commands transmitted by an operator control unit (OCU) in wireless communication with the locomotive controller;

reducing, by the locomotive controller, the speed of the locomotive below the calculated speed limit when the one or more commands received from the OCU include a lower speed command; and stopping, by the locomotive controller, movement of the locomotive prior to reaching the specified stopping point when the one or more commands received from the OCU include a stop movement command.

24. The method of claim 16, wherein:

the train makeup data includes updated train makeup data reflecting any changes to the train makeup; and the method further includes adjusting the calculated speed limit for the locomotive along the track to meet the stopping trajectory according to the grade of the portion of the track along which the locomotive is travelling and the updated train makeup data reflecting any dynamic changes to the train makeup.

25. The method of claim 16, wherein:

the train makeup data includes consist makeup data identifying a locomotive consist that includes said locomotive and train car makeup data identifying train cars coupled to the locomotive consist; and/or the one or more track grade maps are stored in memory of the locomotive controller and/or a server located remote from the locomotive controller.

26. A locomotive controller comprising:

memory configured to store computer-executable instructions; and a processor in communication with the memory to execute the instructions to:

retrieve one or more track grade maps each indicative of a grade of at least a portion of a track along which a locomotive is travelling;

retrieve train makeup data;

obtain a maximum distance to a specified stopping point of the locomotive along the track; and calculate a speed limit for the locomotive along the track to meet a stopping trajectory for providing dynamic point protection, according to the retrieved track grade map, the retrieved train makeup data, and the obtained maximum distance to the specified stopping point.

27. The locomotive controller of claim 26, wherein:

the train makeup data includes consist makeup data identifying a locomotive consist that includes said locomotive and train car makeup data identifying train cars coupled to the locomotive consist;

the locomotive controller is configured to retrieve the train makeup data including updated train makeup data reflecting any changes to the train makeup; and the locomotive controller is configured to adjust the calculated speed limit for the locomotive, according to the grade of the portion of the track along which the locomotive is travelling and the updated train makeup data reflecting any changes to the train makeup.

* * * * *